US008391742B2

(12) United States Patent
Kakitani

(10) Patent No.: US 8,391,742 B2
(45) Date of Patent: Mar. 5, 2013

(54) IMAGE FORMING APPARATUS HAVING DETACHABLE DEVELOPING DEVICE

(75) Inventor: Masaki Kakitani, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 270 days.

(21) Appl. No.: 12/827,987

(22) Filed: Jun. 30, 2010

(65) Prior Publication Data

US 2011/0002705 A1 Jan. 6, 2011

(30) Foreign Application Priority Data

Jul. 2, 2009 (JP) ..... 2009-157912

(51) Int. Cl.
*G03G 15/00* (2006.01)
*G03G 15/04* (2006.01)

(52) U.S. Cl. ..... 399/90; 399/119

(58) Field of Classification Search ..... 399/90, 399/119, 120
See application file for complete search history.

(56) References Cited

U.S. PATENT DOCUMENTS

| | | | | |
|---|---|---|---|---|
| 5,918,089 | A * | 6/1999 | Malinich et al. | 399/90 |
| 6,453,136 | B1 | 9/2002 | Yasumaru | |
| 2002/0085854 | A1* | 7/2002 | Numagami et al. | 399/90 |
| 2004/0131379 | A1 | 7/2004 | Numagami | |
| 2011/0033202 | A1* | 2/2011 | Imai | 399/111 |
| 2011/0091222 | A1* | 4/2011 | Kim et al. | 399/9 |

FOREIGN PATENT DOCUMENTS

| | | |
|---|---|---|
| JP | 2001-222207 | 8/2001 |
| JP | 2001-343882 | 12/2001 |
| JP | 2004-126020 | 4/2004 |
| JP | 2006-221010 | 8/2006 |
| JP | 2006221010 A * | 8/2006 |

* cited by examiner

*Primary Examiner* — David Gray
*Assistant Examiner* — Tyler Hardman
(74) *Attorney, Agent, or Firm* — Canon USA Inc IP Division

(57) ABSTRACT

At least one of driving motors that drive a developing device independently of each other is provided on a door capable of opening and closing to allow the developing device to be attached to or detached from a main body of an apparatus. An electrical contact portion that can be electrically connected to or disconnected from an electrical circuit provided in the main body is provided for the driving motor provided on the door.

7 Claims, 10 Drawing Sheets

IMAGE FORMING APPARATUS HAVING DETACHABLE DEVELOPING DEVICE

BACKGROUND OF THE INVENTION

1. Field of the Invention

The present invention relates to an image forming apparatus including a developing device that is detachably attached to a main body of the image forming apparatus. More particularly, the present invention relates to an image forming apparatus including a plurality of driving units which drive the developing device independently of each other.

2. Description of the Related Art

Recently, there have been increasing demands for color copy machines in offices, and tandem-drum-type copy machines including a plurality of photosensitive drums, which are advantageous in view of printing speed, have become popular. Various types of inner structures are adopted in tandem-drum-type copy machines. For example, a structure in which four photosensitive drums are arranged in a horizontal direction is relatively commonly used.

Japanese Patent Laid-Open No. 2001-222207 discusses an apparatus including an open-close unit that can be opened and closed. The open-close unit is opened and closed to allow process cartridges to be attached to or detached from the apparatus.

A developing section generally includes a developing-agent holding member for developing a latent image and a conveying member for mixing and conveying a developing agent. The developing-agent holding member and the conveying member may be driven independently of each other. Accordingly, a plurality of motors may be provided to drive the developing-agent holding member and the conveying member under optimum driving conditions.

In the case where there is only one driving motor for driving the developing device, the driving motor is disposed behind the developing device in the direction in which the developing device is detached from the apparatus. Therefore, the developing device does not interfere with the driving motor when the developing device is attached to or detached from the main body of the apparatus.

In the case where a plurality of driving motors are provided to drive the developing device, it is difficult to place all of the driving motors behind the developing device because the space is limited. Therefore, one or more of the driving motors may be provided in front of the developing device. However, in such a case, the driving motors placed in front of the developing device must be removed to take out the developing device from the main body of the apparatus, and the ease of maintenance is reduced.

SUMMARY OF THE INVENTION

The present invention provides an image forming apparatus which includes a detachable developing device having an image-developing-agent holding member and a developing-agent conveying member that are driven independently of each other and which allows replacing of the developing device without reducing the ease of operation even when driving motors are disposed in front of and behind the developing device in the direction in which the developing device is detached.

An image forming apparatus according to an aspect of the present invention includes a developing device detachably attached to a main body of the image forming apparatus, the developing device developing a latent image on an image bearing member; a door capable of opening and closing to allow the developing device to be detached from the main body; a plurality of driving units provided in the main body and capable of driving the developing device independently of each other, at least one of the driving units being provided on the door; and an electrical contact portion provided on the door and capable of being electrically connected to or disconnected from an electrical path provided in the main body, the electrical contact portion allowing electricity to be supplied from the main body to the at least one of the driving units that is provided on the door.

Further features of the present invention will become apparent from the following description of exemplary embodiments with reference to the attached drawings.

DESCRIPTION OF THE EMBODIMENTS

An embodiment of the present invention will now be described with reference to the accompanying drawings. The embodiment is described to explain the present invention by way of example, and dimensions, materials, shapes, relative positions, etc., of components described below are not intended to limit the scope of the present invention unless specifically stated otherwise.

Figure 2:
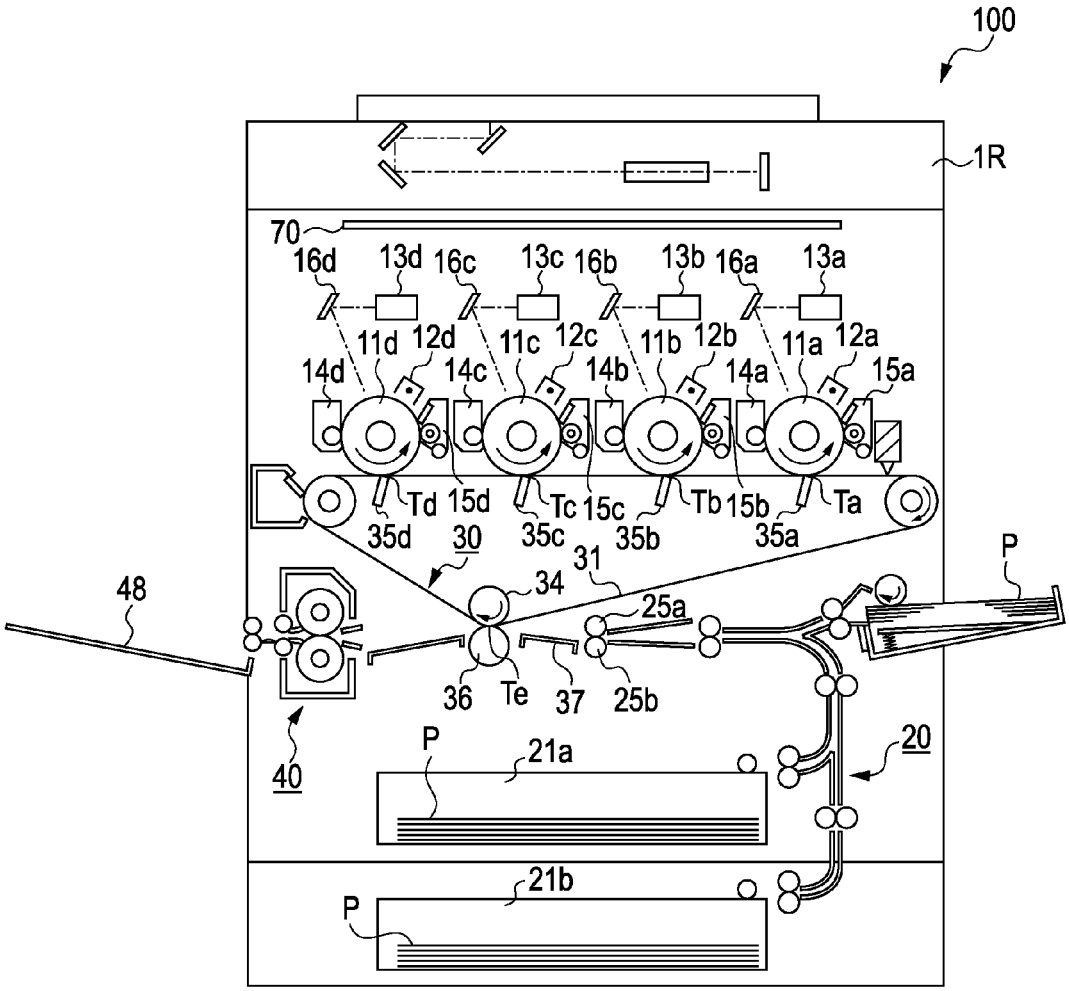
FIG. 2 is a sectional view of an image forming apparatus (full-color copy machine) according to the embodiment of the present invention.

FIG. 2 shows a schematic sectional view of an image forming apparatus 100 according to the embodiment of the present invention.

In FIG. 2, photosensitive drums 11*a* to 11*d*, which are image bearing members, are supported in a rotatable manner. First charging devices 12*a* to 12*d*, laser exposure optical systems 13*a* to 13*d*, developing units 14*a* to 14*d*, and photosensitive-member cleaners 15*a* to 15*d* are disposed around the photosensitive drums 11*a* to 11*d*, respectively. An intermediate transfer member 30 is disposed near the photosensitive drums 11*a* to 11*d*. The intermediate transfer member 30 includes first transfer blades 35*a* to 35*d* that are pressed against the photosensitive drums 11*a* to 11*d*, respectively, with an intermediate transfer belt 31 interposed therebetween.

Toner images are formed on the photosensitive drums 11*a* to 11*d* and are transferred onto the intermediate transfer belt 31 by the first transfer blades 35*a* to 35*d* at first transfer sections Ta to Td, respectively. The intermediate transfer member 30 also includes second transfer rollers 34 and 36 that transfer the toner images on the intermediate transfer belt 31 onto a transfer sheet P.

The laser exposure optical systems 13*a* to 13*d* receive image signals from a reading section 1R and temporarily store the image signals in image memories. Then, laser output units covert the image signals into optical signals. With regard to laser beams corresponding to the optical signals, laser beams corresponding to polygon-mirror optical signals are reflected by polygon mirrors and are incident on surfaces of the photosensitive drums 11*a* to 11*d* after passing through lenses and being reflected by reflective mirrors 16*a* to 16*d*. In the following description, a representative of, for example, the photosensitive drums 11*a* to 11*d* will be described as a photosensitive drum 11 by omitting the indices 'a' to 'd'.

In an image forming process performed in a printer section, each photosensitive drum 11 is rotated. Electric charges on the photosensitive drum 11 is removed by a pre-exposure lamp (not shown), and then the photosensitive drum 11 is uniformly charged by the corresponding first charging device 12. Then, the photosensitive drum 11 is irradiated with a laser beam image, so that a latent image is formed on the photosensitive drum 11. Then, the latent image formed on the photosensitive drum 11 is developed by the corresponding developing unit 14, so that a toner image made of toner containing resin and colorant as base materials is formed on the photosensitive drum 11. Thus, toner images in respective colors are formed on the four photosensitive drums. The toner images are successively transferred onto the intermediate transfer belt 31 in order from the leftmost station such that the toner images are superimposed with each other without color misregistration, and then are moved to a second transfer section Te.

In each developing unit 14, the toner is supplied from a toner storage unit at suitable timing so that the toner ratio (or the amount of toner) in the developing unit 14 is maintained constant.

Transfer sheets are conveyed one at a time by a sheet-feeding unit from paper-sheet containers 21*a* and 21*b*. Skewing of each transfer sheet is corrected by registration rollers 25*a* and 25*b*, and then the transfer sheet is conveyed to the second transfer rollers 34 and 36 at suitable timing.

Then, the transfer sheet onto which the toner images have been transferred in a transferring section is conveyed to a heat-roller fixing unit 40, where the toner images are fixed. Then, the transfer sheet is ejected to a paper ejection tray 48.

Figure 3:
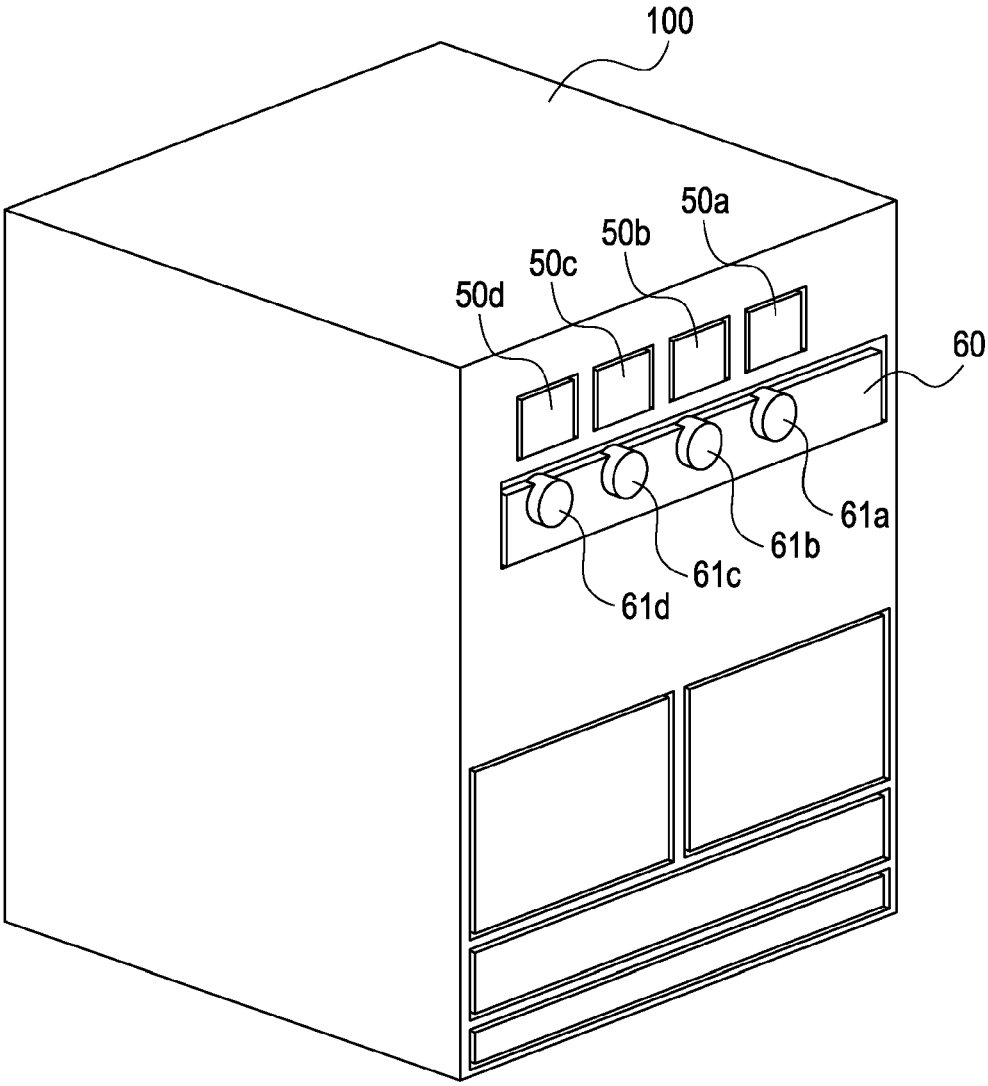
FIG. 3 is a schematic diagram illustrating the image forming apparatus according to the embodiment of the present invention in the state in which a front door is closed.
Figure 10A:
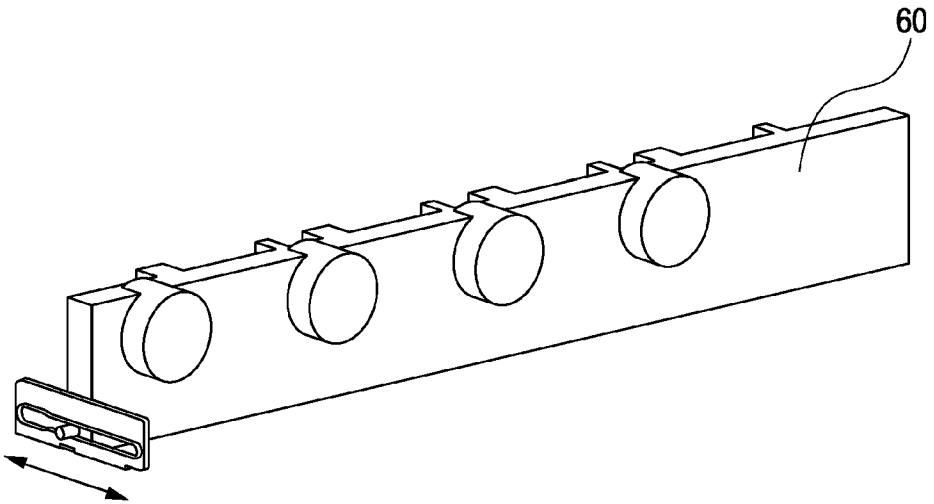
FIGS. 10A and 10B are diagrams illustrating the movement of the front door according to the embodiment of the present invention.

The schematic structure of the main body of the apparatus will now be described. As illustrated in FIGS. 3 and 4A to 4C, doors 50 for toner bottles 52 and a front door 60 are provided at the front side of the main body of the image forming apparatus 100. The doors 50 are provided for respective colors, and can be opened and closed. The doors 50 are opened and closed when the tonner bottles 52 are to be replaced (see FIG. 4A). The front door 60 can be opened and closed with respect to the main body. The front door 60 is opened and closed when a process cartridge 10 is to be replaced by a new process cartridge. The front door 60 can be opened and closed between a first position (closed state) at which insertion holes through which the process cartridge 10 can be inserted into the main body are covered by the front door 60 and a second position (opened state) at which the process cartridge 10 can be attached to or detached from the main body. According to the present embodiment, a mechanism for opening and closing the front door 60 is structured as described below. In FIG. 3, the front door 60 is at the closed position. In the present embodiment, as illustrated in FIG. 10A, the front door 60 can be moved horizontally in a front-back direction of the apparatus. In addition, a projection 601 provided at each end of the front door 60 can also be moved horizontally along a front-door guide 86. As described below, an electrical contact portion provided in the main body of the apparatus and an electrical contact portion provided on the front door 60 can be connected to or disconnected from each other in response to the horizontal movement of the front door 60. When the front door 60 is moved horizontally and is then rotated about an end of each front-door guide 86, the front door 60 reaches the position (second position) at which the front door 60 is opened. The process cartridge 10 can be attached to or detached from the apparatus while the front door 60 is at this position.

Figure 4A:
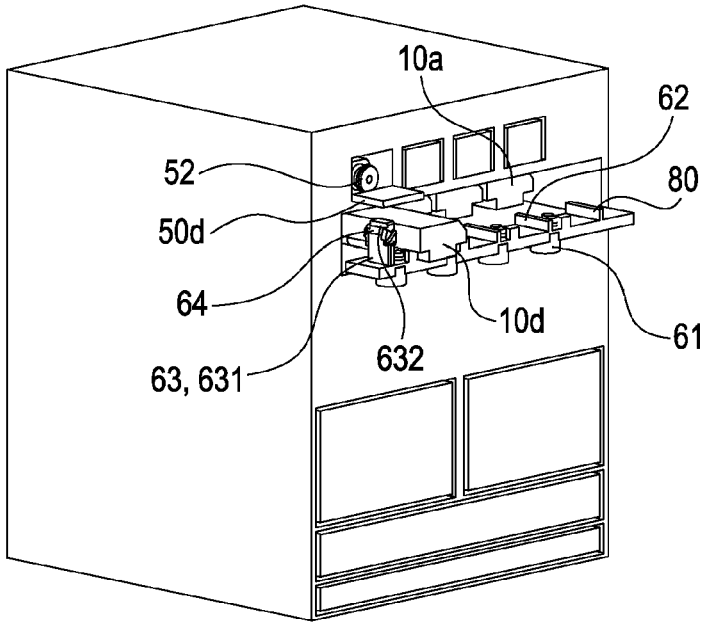
FIGS. 4A to 4C are schematic diagrams illustrating the state in which the front door of the image forming apparatus according to the embodiment of the present invention is opened.
Figure 4B:
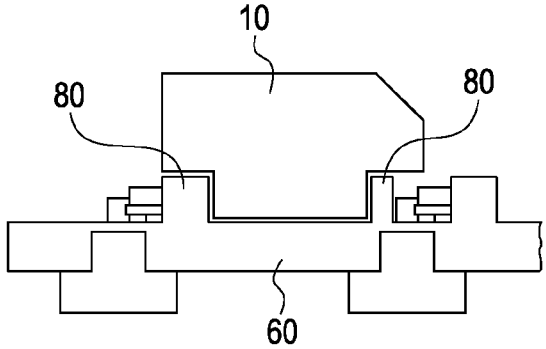

The front door 60 is provided with a guide portion 80 for guiding the process cartridge 10 when the process cartridge 10 is attached or detached. Thus, the process of attaching or detaching the process cartridge 10 is facilitated. More specifically, as illustrated in FIG. 4B, the process cartridge 10 has a portion that is shaped so as to be engageable with the guide portion 80 and placed on the guide portion 80 in the process of attaching or detaching the process cartridge 10.

In addition, as described below, drive inputs are supplied to the process cartridge 10 at both ends thereof in the longitudinal direction. A motor 61 that serves as a drive source for driving the process cartridge 10 is provided on the front door 60. A drive gear unit 62 for transmitting the driving force from the motor 61 to the developing unit 14 is also provided on the front door 60. A drawer 63 is provided on the front door 60 as an electrical connection unit, and electricity is supplied from the drawer 63 to the motor 61 through electric lines (not shown) that extend from the drawer 63. When the front door 60 is closed, the drawer 63 is electrically connected to the electrical contact portion (not shown) provided in the main body of the apparatus.

Figure 4C:
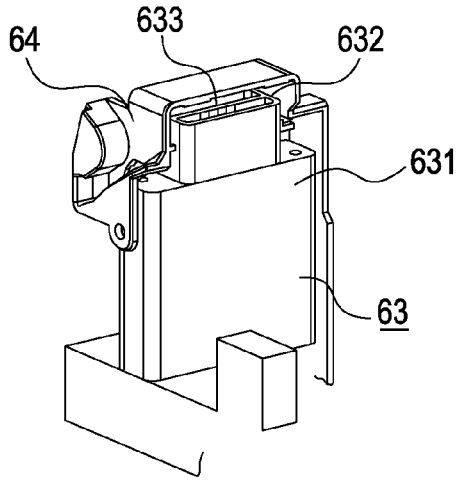

The structure of the drawer 63 will now be described in more detail. As illustrated in FIG. 4C, the drawer 63 includes an electrical contact member 633 having a linear shape that provides an electrical connection with the electrical contact portion in the main body of the apparatus.

As illustrated in FIG. 4C, the drawer 63 also includes a cover member 631 which is disposed so as to face an electrical contact portion of the electrical contact member 633 and which covers an area surrounding the electrical contact portion. The cover member 631 has an opening (connection hole) 632 in which the electrical contact portion in the drawer 63 is electrically connected to an electrical path (electrical contact portion) provided in the main body of the apparatus. When the front door 60 is opened as in FIG. 4A, an inner surface of the front door 60 faces upward, opposite to the direction of gravity, and the opening 632 also faces upward. The drawer 63 is also provided with a drawer shutter 64 that covers the opening 632. The electrical contact portion in the drawer 63 refers to a portion at which an electrical contact member (not shown) in the main body of the apparatus and the electrical contact member 633 in the drawer 63 come into contact with each other. If the toner adheres to this section, there is a risk that the toner will be spread and fused when the electrical contact members are connected to each other. In such a case, the stability of electrical connection will be reduced. Therefore, according to the embodiment of the present invention, a structure for suppressing the toner from adhering to the electrical contact portion is provided, as described below.

Figure 5A:
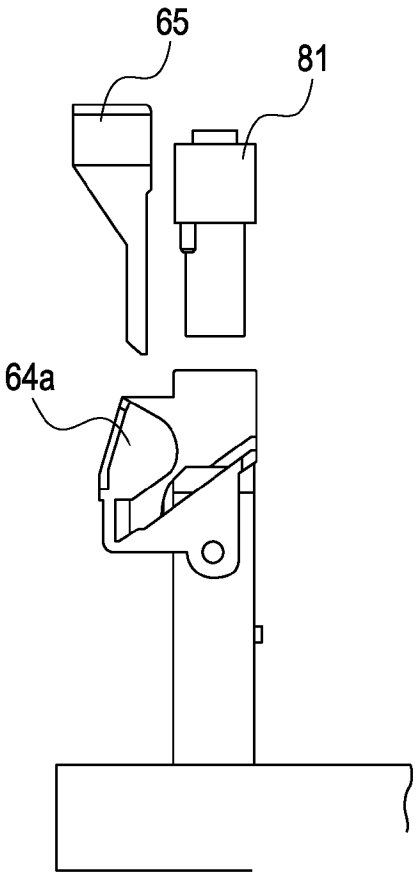
FIGS. 5A to 5C are diagrams illustrating the movement of a drawer shutter according to the embodiment of the present invention.
Figure 5B:
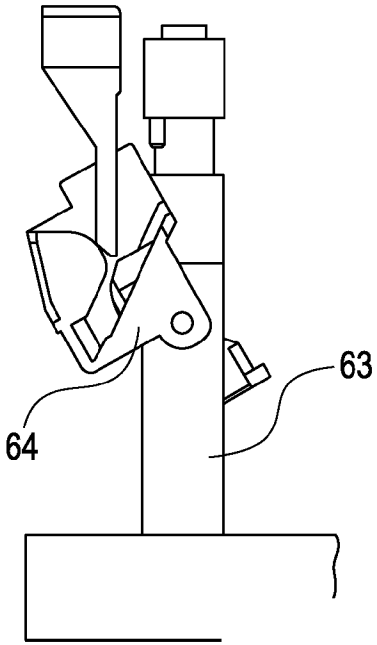
Figure 5C:
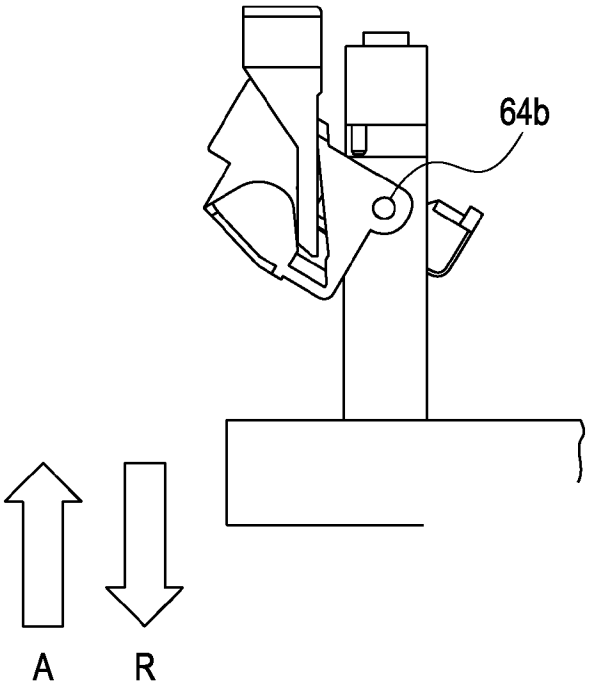
Figure 10B:
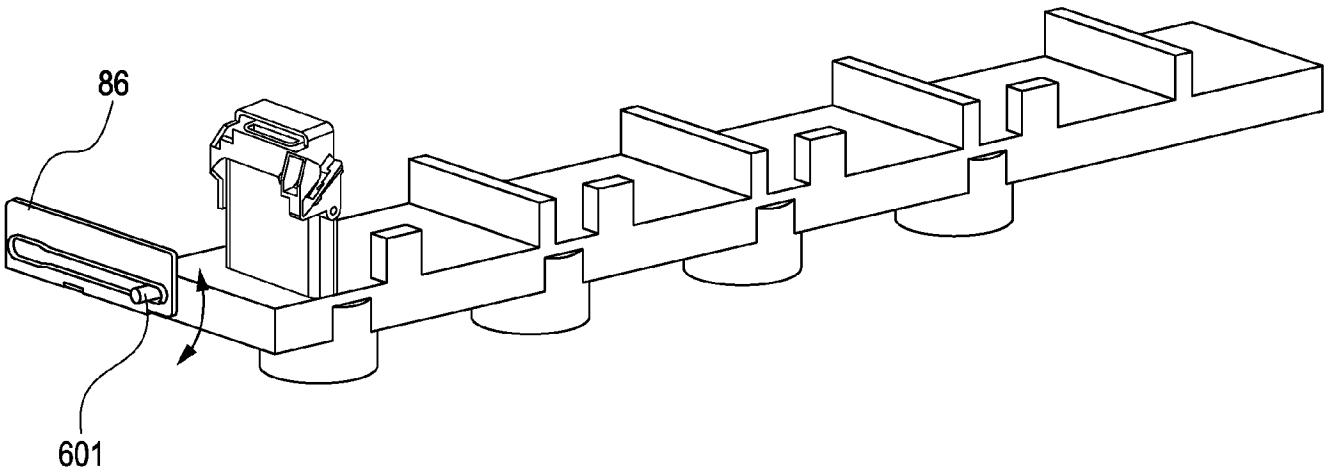

The drawer shutter 64 will now be described. FIGS. 5A to 5C show the opening and closing movements of the drawer shutter 64. FIGS. 5A to 5C are diagrams illustrating the views from the top of the main body of the apparatus illustrated in FIG. 4A. FIGS. 5A to 5C show a shutter opening-and-closing member 65 provided in the main body, a drawer 81 provided in the main body, the drawer shutter 64, and the drawer 63. The drawer 81 provided in the main body has a projecting shape (serves as a male component) and includes the electrical contact portion on the outer surface of the projection. The drawer 63 has a recessed shape (serves as a female component) and includes the electrical contact member 633 on the inner surface of the recess. The drawers 81 and 63 are moved with respect to each other to establish or cancel the electrical connection therebetween. The operation will be described with reference to FIGS. 10A and 10B. To facilitate understanding, only the front door 60 and the front-door guide 86 at one end thereof are illustrated in FIGS. 10A and 10B. FIG. 10A illustrates the state in which the drawer 63 is slid horizontally in a direction away from the main body of the apparatus. FIG. 10B illustrates the state in which the front door 60 is rotated after being slid horizontally. When the front door 60 is moved along the arrow shown in FIG. 10A, the projection provided on the front door 60 at each end thereof moves in the front-door guide 86. Then, after the projection on the front door 60 at each end thereof reaches an end of the front-door guide 86, the front door 60 is rotated. Thus, the front door 60 is rotated about the projection at each end thereof.

The drawer shutter 64 is opened or closed in response to the horizontal movement of the front door 60 in the front-back direction as shown in FIG. 10A. More specifically, when the front door 60 is moved in the direction shown by arrow A in FIG. 5A, the shutter opening-and-closing member 65 provided in the main body of the apparatus comes into contact with a cam surface 64*a* of the drawer shutter 64. Accordingly, the drawer shutter 64 starts to open by swinging about a rotational center 64*b*. Then, when the shutter opening-and-closing member 65 is further moved in the direction shown by arrow A as illustrated in FIGS. 5B and 5C, the drawer shutter 64 opens completely. As a result, the drawer 63 and the drawer 81 in the main body of the apparatus become electrically connected to each other. Conversely, when the front door 60 is opened, the front door 60 is moved in the direction shown by arrow R in FIGS. 5A to 5C so that the opening 632 in the drawer 63 is automatically covered. The drawer shutter 64 is provided with an urging member that urges the drawer shutter 64 in a direction for covering the drawer 63.

Figure 6:
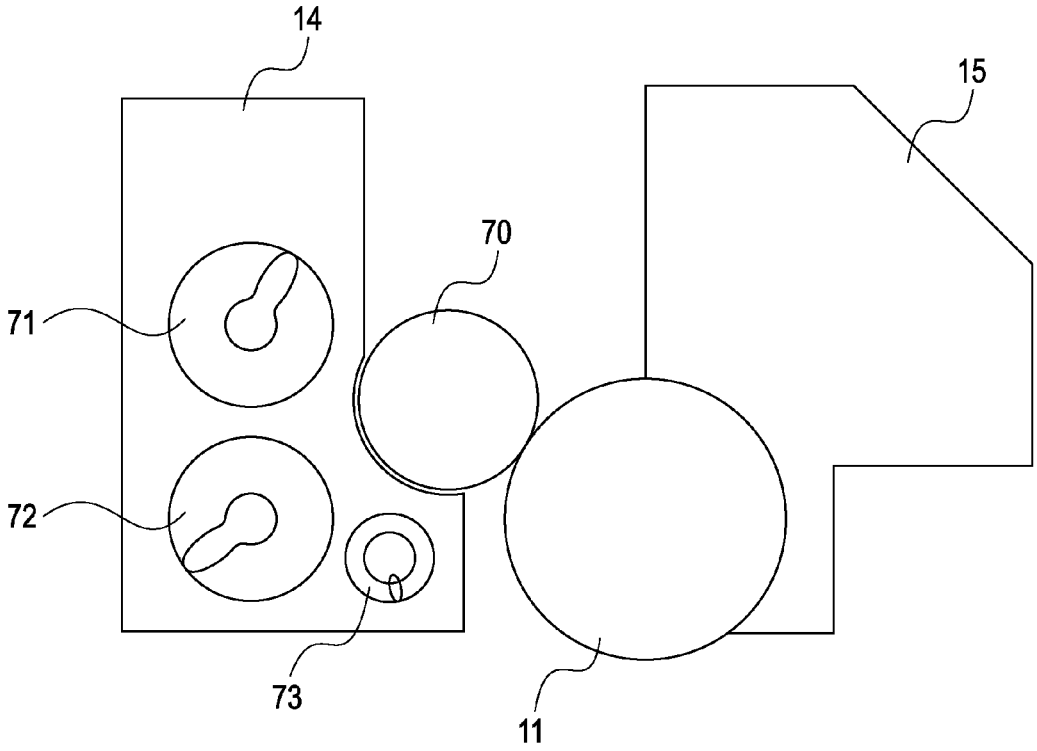
FIG. 6 is a sectional view of a process cartridge according to the embodiment of the present invention.
Figure 7:
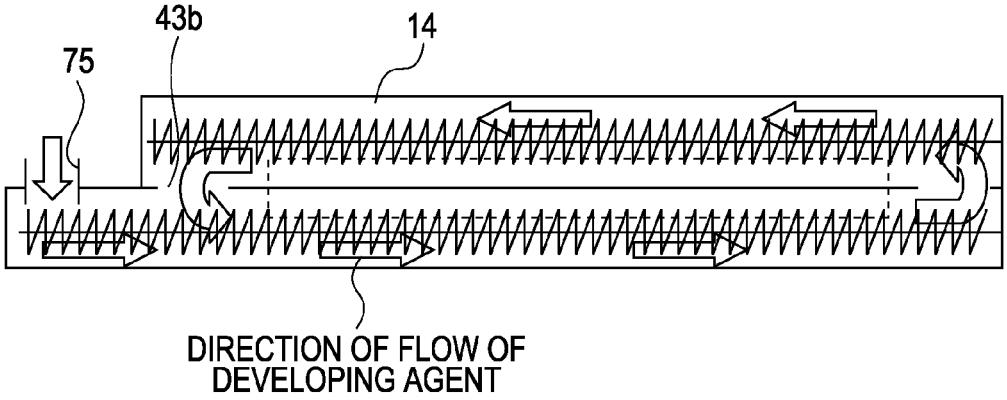
FIG. 7 is a diagram illustrating the circulation of a developing agent in the process cartridge according to the embodiment of the present invention.

The structure of the developing unit 14 according to the present invention will now be described with reference to FIGS. 6 and 7. The developing unit 14 includes a developing sleeve 70 that holds a layer of developing agent in a uniform thickness and supplies the toner to the photosensitive drum 11 and developing screws 71, 72, and 73 that mix and circulate the developing agent in the developing unit 14. The developing screws 71, 72, and 73 mix and circulate the developing agent so that the toner supplied by a toner supplying mechanism through a supply hole 75 formed in the developing unit 14 is evenly mixed with the developing agent in the developing unit 14.

The developing screws 71 and 72 are provided as an upper screw and a lower screw, respectively, and are separated from each other by a wall. The developing agent is transferred through the developing unit 14 that is sectioned by the wall.

In the developing unit 14 of a vertical mixing type used in the present embodiment, the developing screws are arranged in the vertical direction. Therefore, the developing agent is circulated between the upper and lower screws in the direction shown by the arrows in FIG. 7. The surface of the developing agent that is being circulated is maintained at a predetermined height around the upper screw 71, and the developing sleeve 70 is immersed in the developing agent so that the developing agent can be supplied to the developing sleeve 70. A magnet is disposed in the developing sleeve 70, so that the developing agent, which contains a magnetic material, adheres to the developing sleeve 70 so as to cover the developing sleeve 70. The developing agent that has adhered to the developing sleeve 70 is smoothed by a developing blade (not shown) to a predetermined uniform thickness, and then comes into contact with the photosensitive drum 11 to develop the latent image.

Figure 8:
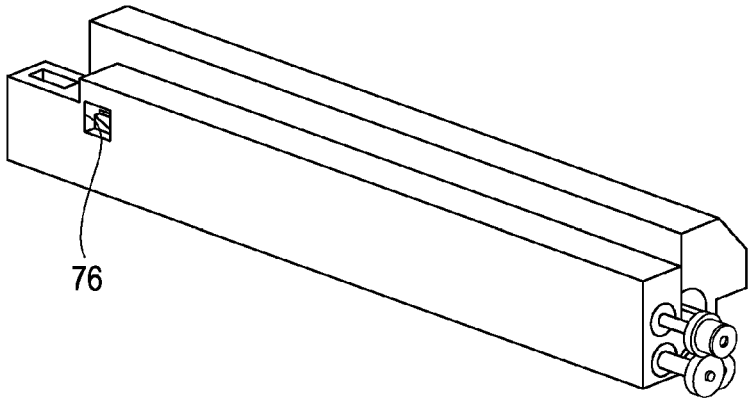
FIG. 8 is a schematic diagram illustrating the developing unit according to the embodiment of the present invention.

As illustrated in FIG. 8, an ejection hole 76 is provided at a downstream position of the upper screw 71. The developing agent that has been degraded while being circulated as illustrated in FIG. 7 is periodically ejected to the outside of the developing unit 14. Accordingly, a fresh developing agent can be constantly used in the developing process.

Figure 9:
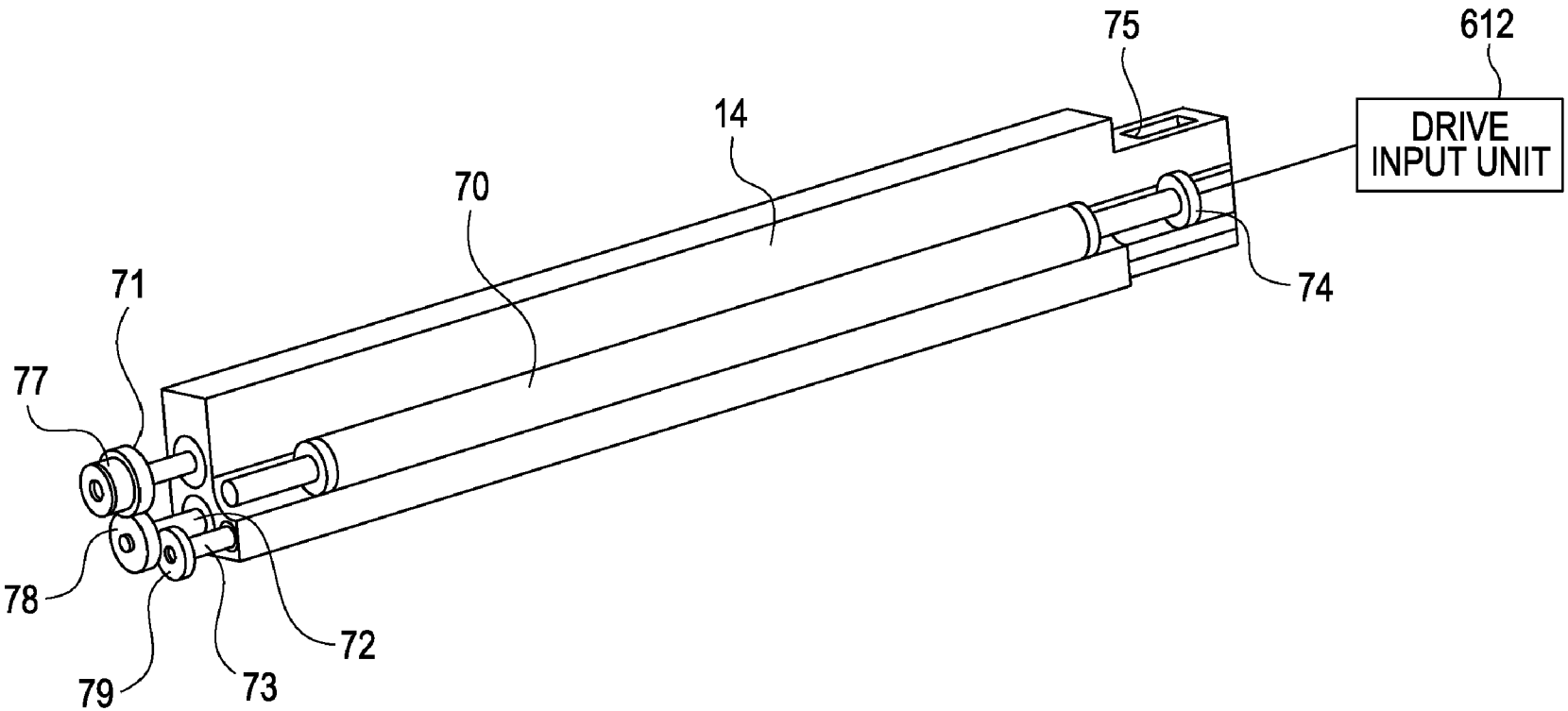
FIG. 9 is a schematic diagram illustrating the developing unit according to the embodiment of the present invention.

As illustrated in FIG. 9, the developing unit 14 includes a gear 74 on a shaft of the developing sleeve 70 at one end thereof in the longitudinal direction. In addition, gears 77, 78, and 79 are provided on shafts of the developing screws 71, 72, and 73 at the other end of the developing unit 14 in the longitudinal direction. The gear 74 receives a driving force from a drive input unit 612 provided in the main body of the apparatus, and independently drives only the developing sleeve 70. The gear 77 receives a driving force from the motor 61 through the drive gear unit 62 provided on the front door 60, and drives the gears 78 and 79. In this manner, the developing screws 71, 72, and 73 are driven. The rotation speed of the developing sleeve 70 is changed in accordance with the rotation speed of the photosensitive drum 11. However, the rotation speed of the developing screws 71, 72, and 73 must be maintained constant in consideration of the circulation of the developing agent, and cannot be changed together with the rotation speed of the developing sleeve 70. When the structure of the present embodiment is used, the developing sleeve 70 and the developing screws 71, 72, and 73 can be controlled independently of each other.

Figure 11A:
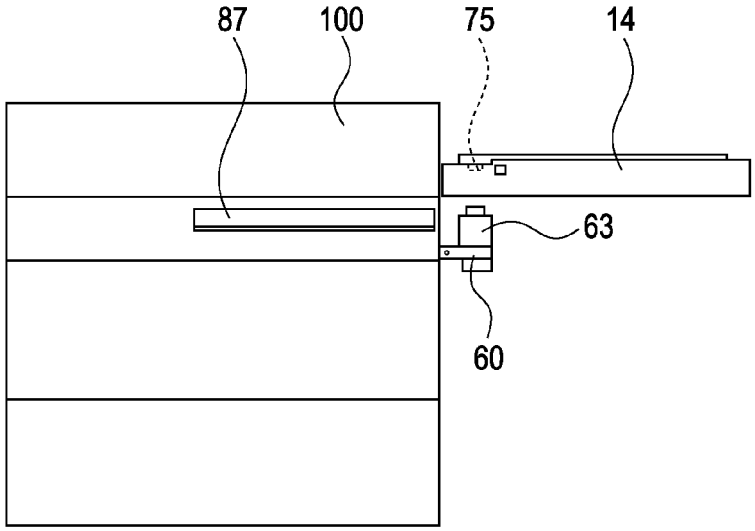
FIGS. 11A to 11C are sectional views of a main body of the image forming apparatus illustrating the process cartridge that is being inserted into the main body.
Figure 11B:
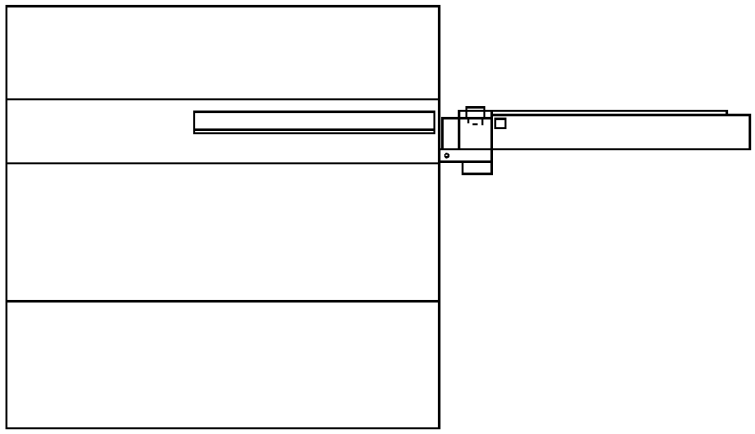
Figure 11C:
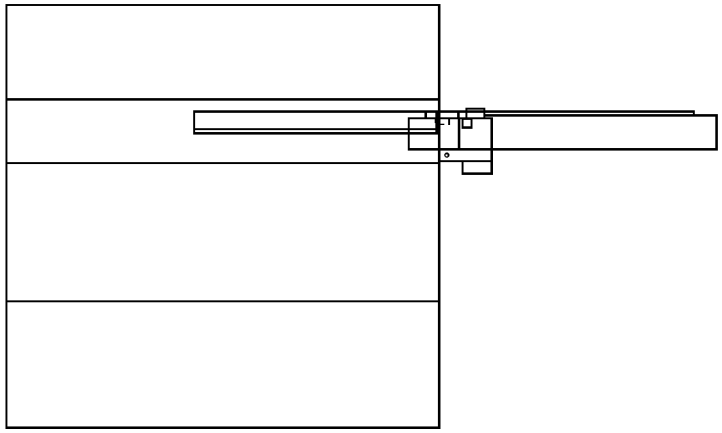

The above-described image forming apparatus 100 has high usability since the process cartridge 10 can be inserted into and pulled out of the apparatus along the guide provided on the front door 60. Thus, the developing device according to the embodiment of the present invention can be detachably attached to the main body of the apparatus. A process of inserting the process cartridge 10 into the image forming apparatus 100 will now be described in detail with reference to FIGS. 11A to 11C. FIGS. 11A to 11C are sectional views of the main body of the apparatus at a position near the drawer 63. As described above, a guide is provided on the front door 60, and the process cartridge 10 is placed on the guide in the process of inserting the process cartridge 10 into the main body of the apparatus.

When the process cartridge 10 is inserted to the position shown in FIG. 11C, the process cartridge 10 is restrained from moving in the vertical direction by an insertion guide 87 provided in the main body of the apparatus.

According to the present embodiment, when the process cartridge 10 is placed on the guide, the supply hole 75 in the process cartridge 10 is at substantially the same position as the position of the drawer 63 in the front-back direction of the main body, as illustrated in FIG. 11B. In this process, when the process cartridge 10 is placed on the guide on the front door 60 as illustrated in FIGS. 11B ad 11C or when the position of the process cartridge 10 is restrained by the insertion guide 87 in the main body of the apparatus, the ejection hole 76 and the supply hole 75 in the developing unit 14 are positioned below the drawer 63.

Positional Relationship Between Drawer, Supply Hole, and Ejection Hole

The positional relationship between the drawer 63, the supply hole 75 in the process cartridge 10, and the ejection hole 76 in the process cartridge 10 will now be described. This positional relationship is one of characteristic parts of the present invention.

Figure 1:
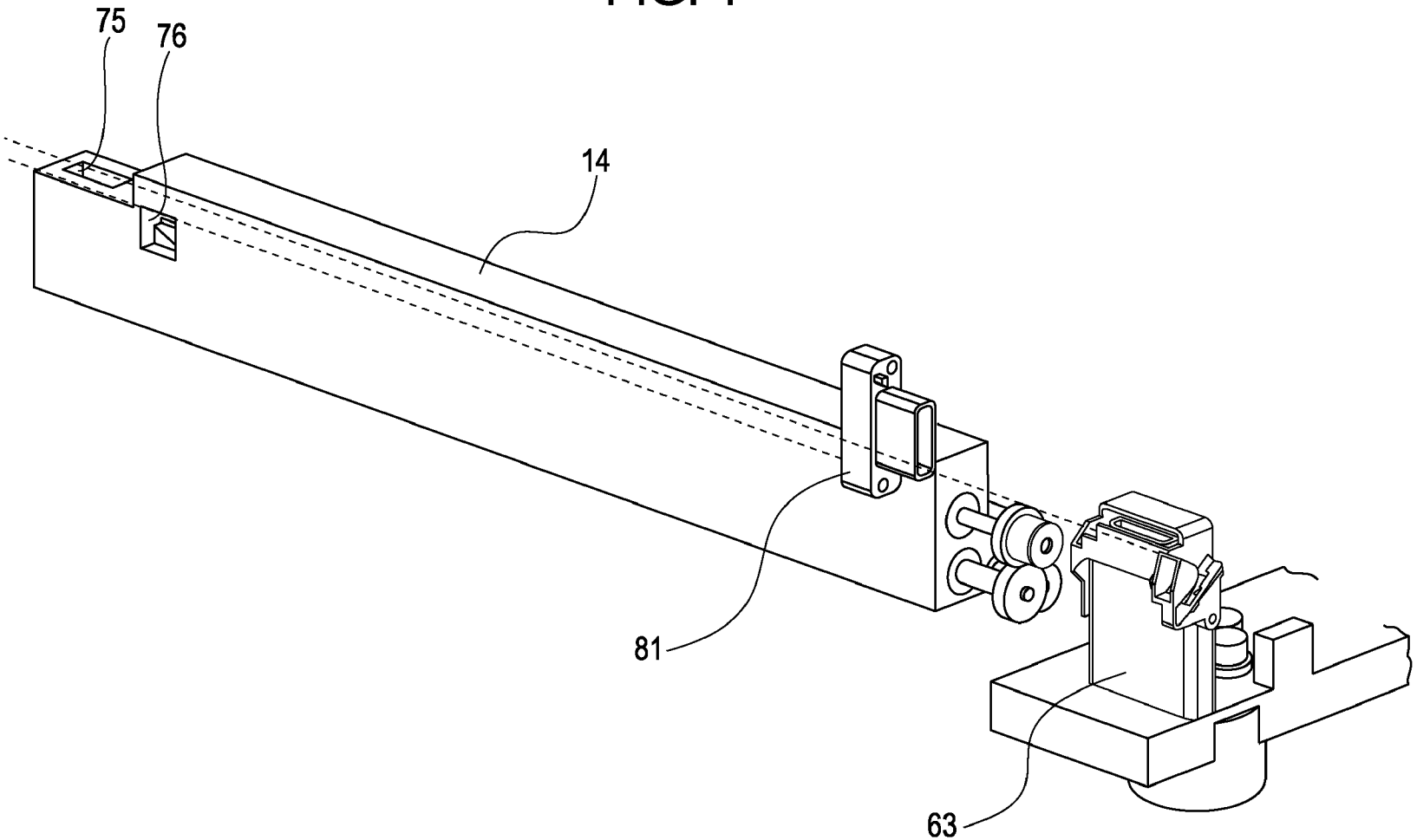
FIG. 1 illustrates the relationship between a developing unit and a drawer according to an embodiment of the present invention.

A small amount of developing agent unavoidably adheres to the supply hole 75 and the ejection hole 76, which are openings. Therefore, the developing agent unavoidably falls on and adheres to the front door 60. Accordingly, as illustrated in FIG. 1, the position of the opening 632 in the cover member 631 of the drawer 63 in the state in which the front door 60 is opened to allow the process cartridge 10 to be detached or attached is set to be above the positions of the supply hole 75 and the ejection hole 76 in the state in which the developing unit 14 is attached to the main body of the apparatus. Therefore, even when the developing agent that has adhered to the supply hole 75 or the ejection hole 76 falls, the developing agent can be prevented from falling on or adhering to the drawer 63. In addition to reducing the possibility of adhesion of the developing agent to the drawer 63 on the front door 60, the possibility of adhesion of the developing agent to the drawer 81 in the main body of the apparatus, to which the drawer 63 is connected, is also reduced by positioning the drawer 81 above the supply hole 75 and the ejection hole 76.

In addition, in the process of moving the process cartridge 10 along the guide, the following positional relationship is established at least when the supply hole 75 and the ejection hole 76 come closest to the opening 632 in the cover member 631 of the drawer 63. That is, the drawer 63 is disposed on the front door 60 such that the opening 632 in the drawer 63 is positioned above the supply hole 75 and the ejection hole 76 in the process cartridge 10. The position at which the supply hole 75 and the ejection hole 76 come closest to the opening 632 is the position at which the supply hole 75 and the ejection hole 76 pass by the opening 632 when the process cartridge 10 is slid in the guiding direction as illustrated in FIGS. 11A to 11C.

In the case where the ejection hole 76 is provided in a side surface of the container as illustrated in FIG. 8, the position of the bottom side of the ejection hole 76 is defined as the position of the ejection hole 76 in the vertical direction. In the case where the ejection hole is formed in a side surface of the container, the developing agent adheres to the ejection hole at a position near the bottom side thereof since the toner is conveyed in a lower section of the container in the direction of gravity. Therefore, adhesion of the developing agent can be suppressed if the opening 632 in the cover member 631 of the drawer 63 is positioned at least above the bottom side of the ejection hole.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-157912 filed Jul. 2, 2009, which is hereby incorporated by reference herein in its entirety.

What is claimed is:

1. An image forming apparatus comprising:

a developing device detachably attached to a main body of the image forming apparatus, the developing device developing a latent image on an image bearing member;

a door capable of opening and closing to allow the developing device to be detached from the main body;

a plurality of driving units provided in the main body and capable of driving the developing device independently of each other, at least one of the driving units being provided on the door; and an electrical contact portion provided on the door and capable of being electrically connected to or disconnected from an electrical path provided in the main body, the electrical contact portion allowing electricity to be supplied from the main body to the at least one of the driving units that is provided on the door.

2. The image forming apparatus according to claim 1, wherein the door is supported such that the door is slidable in a direction for disconnecting the electrical contact portion from the electrical path and such that the door is rotatable so as to cause an inner surface of the door to face vertically upward.

3. The image forming apparatus according to claim 1, wherein the door includes a guide portion that guides the developing device.

4. The image forming apparatus according to claim 3, wherein the developing device is provided with an opening through which a developing agent is supplied to or discharged from the developing device, the electrical contact portion being positioned above the opening when the electrical contact portion and the opening in the Developing device come closest to each other while the developing device is being guided by the guiding portion.

5. The image forming apparatus according to claim 4, further comprising:

a cover portion configured to cover an area around the electrical contact portion and having a connection hole through which the electrical contact portion is connected to the electrical path provided in the main body, wherein the connection hole is positioned above the opening when the connection hole and the opening in the developing device come closest to each other while the developing device is being guided by the guiding portion.

6. The image forming apparatus according to claim 5, further comprising:

an opening-and-closing member capable of causing the connection hole to be covered or uncovered, the opening-and-closing member causing the connection hole to be covered when the electrical contact portion is disconnected from the electrical path provided in the main body.

7. An image forming apparatus comprising:

an image bearing member;

a developing device detachably attached to a main body of the image forming apparatus, the developing device including a developer bearing member for developing an electrostatic latent image formed on the image bearing member and a conveying member for conveying a developer to be supplied to the developer bearing member;

a door capable of opening and closing to allow the developing device to be detached from the main body;

a first and a second driving units provided in the main body wherein the first driving unit is configured to drive the developing agent bearing member, and the second driving unit is configured to drive the conveying member independently from the first driving unit, at least one of the first and second driving units being provided on the door; and an electrical contact portion provided on the door and capable of being electrically connected to or disconnected from an electrical path provided in the main body, the electrical contact portion allowing electricity to be supplied from the main body to the at least one of the first and second driving units that is provided on the door.

* * * * *